United States Patent [19]

Jenkins, Jr. et al.

[11] 4,353,187

[45] Oct. 12, 1982

[54] DOOR REPAIR METHOD AND REPAIR SECTION THEREFOR

[75] Inventors: Oliver J. Jenkins, Jr.; Charles W. Mayfield, both of Youngstown, Ohio

[73] Assignee: The Youngstown Steel Door Company, Cleveland, Ohio

[21] Appl. No.: 206,024

[22] Filed: Nov. 12, 1980

[51] Int. Cl.[3] ..... E06B 3/00

[52] U.S. Cl. ..... 49/501; 52/458; 52/514; 52/814

[58] Field of Search ..... 49/501; 52/458, 457, 52/514, 814

[56] References Cited

U.S. PATENT DOCUMENTS

| | | | |
|---|---|---|---|
| 1,168,539 | 1/1916 | Murphy . | |
| 1,513,363 | 10/1924 | Barrows . | |
| 1,586,265 | 5/1926 | Powell . | |
| 1,689,472 | 10/1928 | Barrows | 49/501 |
| 1,836,230 | 12/1931 | Eklind . | |
| 1,895,151 | 1/1933 | Ditchfield | 52/814 |
| 1,902,546 | 3/1933 | Ditchfield . | |
| 2,045,291 | 6/1936 | Busse | 52/458 |

*Primary Examiner*—Philip C. Kannan

*Attorney, Agent, or Firm*—Fay & Sharpe

[57] ABSTRACT

A corrugated metal door having a damaged lower section is repaired by removing the entire lower damaged section, including the door bottom frame member and portions of the door side frame members, and replacing same with prefabricated door repair section.

11 Claims, 13 Drawing Figures

DOOR REPAIR METHOD AND REPAIR SECTION THEREFOR

BACKGROUND OF THE INVENTION

This invention relates to the art of doors and, more particularly, to a method for repairing a damaged door and to a prefabricated door repair section.

The invention is especially applicable to corrugated metal doors of the type used on railroad cars and will be particularly described with reference thereto. However, it will be appreciated by those skilled in the art that the invention has broader aspects and can be used on doors of other types and in other environments.

Rectangular metal doors of a known type used on railroad cars include a generally rectangular frame having door top, bottom, and opposed side frame members. Corrugated metal panels are disposed between and secured to these frame members for completing the basic door construction.

Doors of the general construction described are highly susceptible to damage from various causes. Typical of such causes are trucks backing into the doors, fork lifts or other material handling equipment striking the door and heavy items striking the door when the items are being loaded or unloaded. Damage may also occur when persons do not fully open the door for car loading or unloading purposes.

In order to repair relatively minor damage to doors of the type described, they are commonly fabricated with three corrugated metal panels so that damaged panels can be removed for repair or replacement. When the door frame members are bent, it is sometimes possible to straighten them once the associated door has been removed from the car. However, damage to the door frame members is frequently so extensive that the frame members cannot be straightened. Under such circumstances, the entire door has typically been scraped.

It has been found that extensive and irreparable damage to the frame members normally occurs in the lower one-third section of the door. That is, either the bottom door frame member of the lower one-third of the side door frame members are most likely to be irreparably damaged. This is undoubtedly due to the fact that the lower one-third section of the door is closest to the car floor so that equipment, trucks and movement of items is most likely to result in damage to the door nearer the car floor than at locations spaced substantially above the floor.

It has been considered desirable to develop a way of economically and simply repairing extensive damage to lower sections of corrugated metal doors so as to reduce the occurrences of scrapping entire doors. Such a repair arrangement should be readily adapted to use with a wide varity of door sizes and styles.

BRIEF SUMMARY OF THE INVENTION

A repair method and a prefabricated repair section for use on a rectangular corrugated metal door having a rectangular frame including top and bottom door frame members and opposite side door frame members. Corrugated panel means is secured to the frame for covering same. A door having a damaged lower section is repaired by removing the entire damaged section. This section includes the bottom door frame member, the damaged section lengths of the side door frame members and that portion of the panel means extending across the damaged section lengths of the side door frame members.

Removal of the entire damaged lower section of the door leaves a substantially undamaged upper section having a generally inverted U-shaped frame including the top door frame member along with substantially undamaged section lengths of the door side frame members. The undamaged section lengths of the side door frame members have bottom ends and the generally inverted U-shaped frame is covered by the remaining undamaged portion of the panel means.

Repair of the door is effected by providing a door repair section having a generally U-shaped repair section frame including a repair section bottom frame member and opposite repair section side frame members. The repair section side frame members have top ends and the repair section frame is covered with a repair section panel of corrugated construction.

The repair section is positioned in place of the removed lower damaged section and is secured to the substantially undamaged upper section. More particularly, the door repair section is positioned with the top ends of its repair section side frame members abutting the bottom ends of the undamaged lengths of the side door frame members on the undamaged section to define frame abutment joints. These abutment joints are preferably welded together and spline members are also positioned to extend across the abutment joints. These spline members are, in turn, welded to the outer surfaces of the repair section and the undamaged section.

In a preferred arrangement, the upper edge portion of the repair section panel overlaps the bottom edge portion of the undamaged section panel portion to define lapped panel portions. The lapped panel portions are welded together at the lapped area therebetween.

When the damaged lower section is removed from a door, it is preferably done in a manner which provides a panel tongue portion extending downwardly below the bottom ends of the undamaged section lengths of the side door frame members on the undamaged sections. This provides an overlap with the upper edge portion of the repair panel on the repair section.

The repair section side frame members have panel mounting flanges with inner surfaces and the repair section corrugated panel is secured to the panel mounting flanges in engagement with the inner surfaces thereof. The corrugated panel has a flat top portion which lies substantially in a common plane with the inner surfaces of the panel mounting flanges. This provides a flat area for welding when the panels are overlapped.

The repair section bottom frame member carries replacement rollers which movably support the repaired door on a track in the same manner as the original. Also included is a replacement hook for holding a repaired door in an open position.

The principal object of the invention is the provision of an improved method of repairing a damaged door.

It is also an object of the invention to provide such a repair method which is very economical and which reduces the amount of scrap heretofore associated with door repairs.

An additional object of the present invention is the provision of a prefabricated door repair section.

Still a further object of the invention is to provide a substantially universal door repair section which can be used for repairing a variety of different door constructions and sizes.

Other objects and advantages for the invention will become apparent to those skilled in the art upon a reading and understanding of the following specification.

BRIEF DESCRIPTION OF THE DRAWINGS

The invention may take form in certain parts and arrangements of parts, a preferred embodiment of which will be described in detail in this specification and illustrated in the accompanying drawings which form a part hereof and wherein.

DETAILED DESCRIPTION OF A PREFERRED EMBODIMENT

Figure 1:
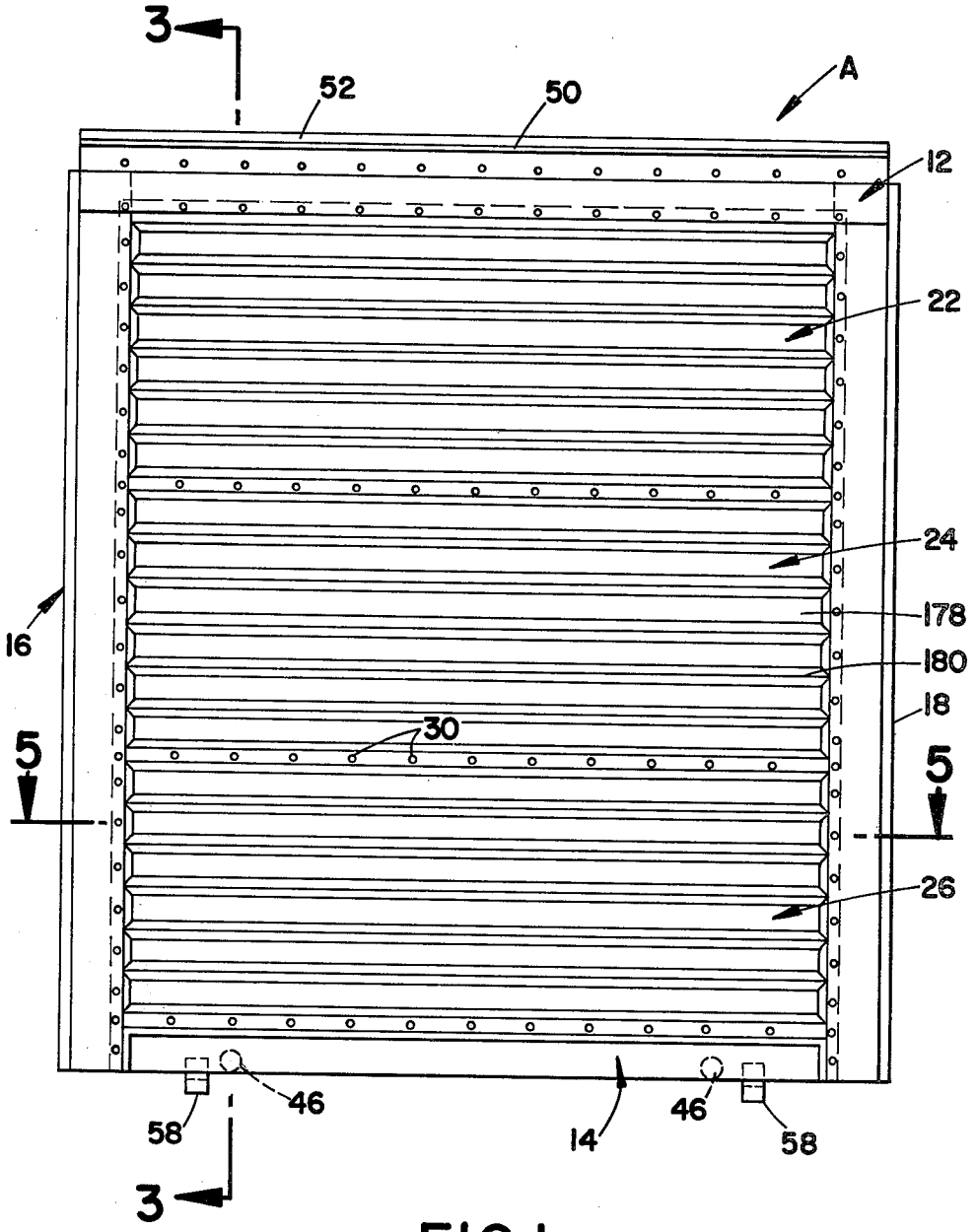
FIG. 1 is a front elevational view of a conventional corrugated metal door of a type used on railway cars.

Referring now to the drawings wherein the showings are for purposes of illustrating a preferred embodiment of the invention only and not for purposes of limiting same, FIG. 1 shows a rectangular corrugated metal door A which includes a generally rectangular frame defined by top and bottom door frame members 12, 14 and parallel opposite side door frame members 16, 18. The opposite side door frame members are continuous and extend the full height of the door, with top and bottom frame members 12, 14 being welded between the opposite end portion of frame members 16, 18. Corrugated metal panel means is riveted or otherwise suitably secured to the frame and, in the arrangement shown, this panel means is in the form of separate upper, middle and lower corrugated panel sections 22, 24 and 26. Middle panel 24 has its top and bottom edge portions respectively overlapping the bottom edge portion of upper panel 22 and the upper edge portion of lower panel 26. The overlapping panel portions are riveted together and, in the arrangement shown, all of the panels have their edge portion riveted to the frame member.

The improved method and repair section of the present invention are for repairing extensive damage to a lower damaged section of door A extending upwardly from bottom frame member 14 a distance substantially less than one-half the total height of door A. More specifically, the improved method and repair section are for repairing approximately the bottom one-third section of door A by replacing such section in its entirety. Thus, when irreparable damage occurs to the bottom one-third of side door frame members 16, 18 or to door bottom frame member 14, the entire bottom one-third of door A is considered to define a damaged lower section. Rivets 30 in FIG. 1 extending through the flat overlapped portions of middle panel 24 and lower panel 26 are popped for disconnecting the middle and lower panels. Approximately the bottom one-third of side door frame members 16, 18 are then severed for separating the entire damaged lower section from the remainder of the door.

Figure 2A:
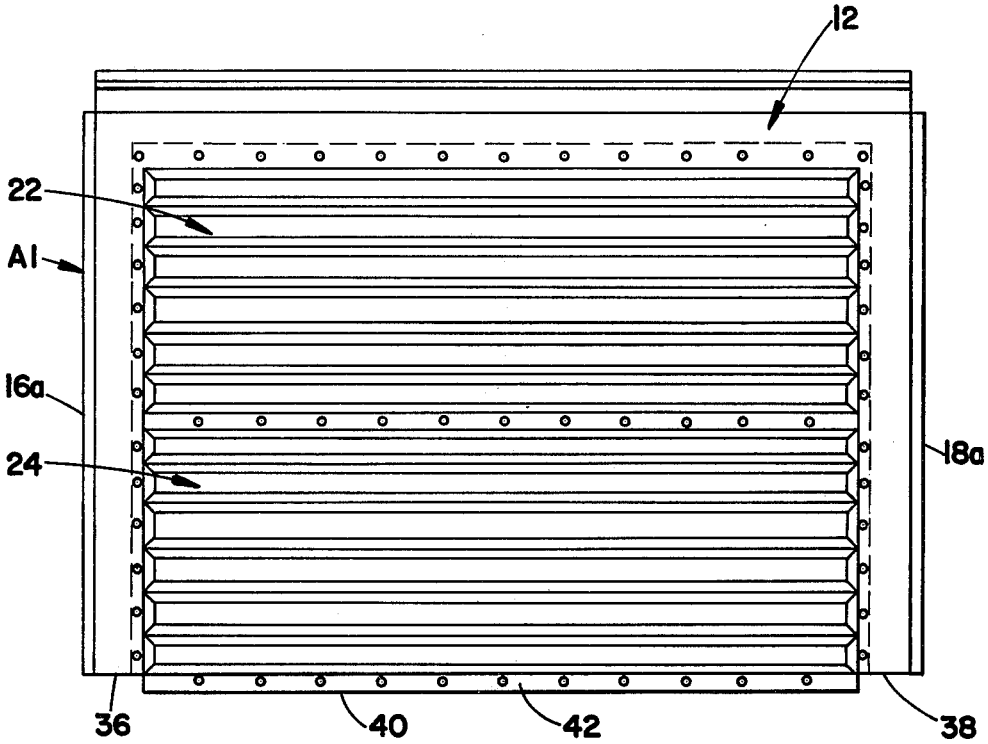
FIG. 2A is a front elevational view of a substantially undamaged upper section of the door of FIG. 1 after removal from the FIG. 1 door of a damaged lower section.
Figure 2B:
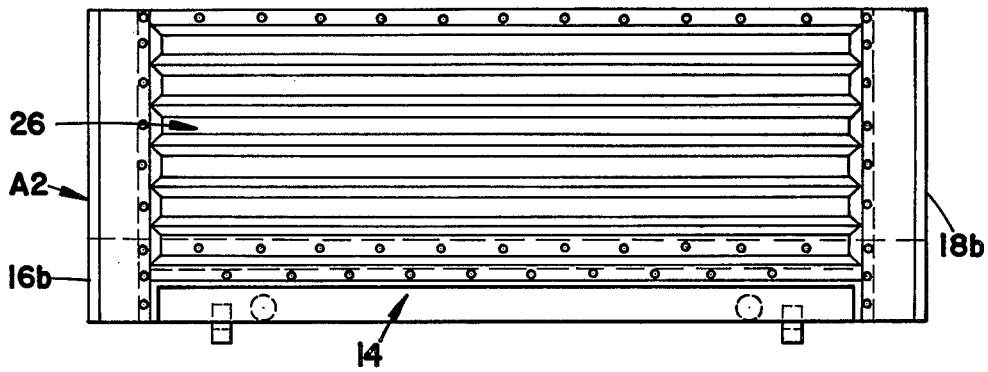
FIG. 2B is a front elevational view of the damaged lower section which has been removed from the upper section of FIG. 2A.

FIGS. 2A and 2B show the substantially undamaged upper section A1 which remains after the lower damaged section A2 is removed therefrom. As shown in FIG. 2A, undamaged upper section A1 has a generally U-shaped frame including top frame member 12 along with undamaged section lengths **16*a*, 18*a* of the door side frame members. Undamaged upper section A1 has the frame thereof covered by an undamaged section panel portion of the panel means defined by upper panel 22 and middle panel 24. Undamaged section side frame members 16*a*, 18*a* have bottom ends 36, 38. Bottom edge 40 of corrugated panel 24 extends across undamaged upper section side frame members 16*a*, 18*a* adjacent bottom ends 36, 38 thereof. In the preferred arrangement, panel bottom edge 40 is spaced outwardly below side frame member bottom ends 36, 38 to provide a projecting panel tongue portion 42 which is substantially flat and lies substantially in a common plane with inner surfaces of panel mounting flanges on side frame members 36, 38**.

As shown in FIG. 2B, damaged lower section A2 includes bottom door frame member 14 along with substantially equal lengths **16*b*, 18*b* of the side door frame members. Lower panel 26 also remains attached to frame members 14, 16*b* and 18*b***.

Figure 3:
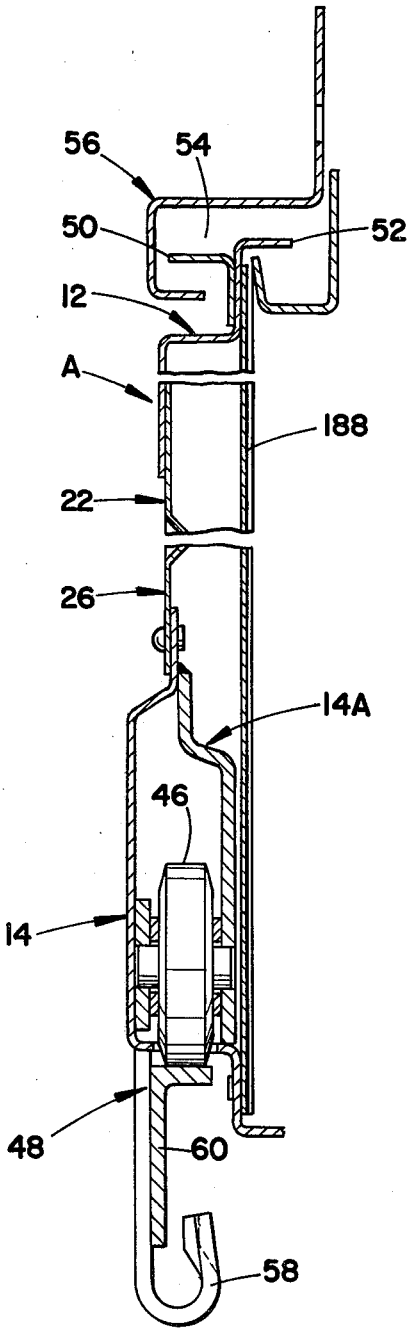
FIG. 3 is a vertical cross-sectional elevational view of the door generally taken along lines 3—3 of FIG. 1.

As shown in FIG. 3, bottom frame member 14 of conventional door A includes brackets **14*a* for defining a space within which rollers 46 are rotatably mounted in a position projecting outwardly below bottom frame member 14 for rollably supporting door A on a track 48 of a car door frame. Upper frame member 12 has oppositely extending portions 50, 52 received in an upper channel portion 54 of the upper car door frame 56. Hook members 58 extending downwardly from bottom frame member 14 receive a downwardly projecting flange 60 on rail 48** in a known manner.

Figure 4:
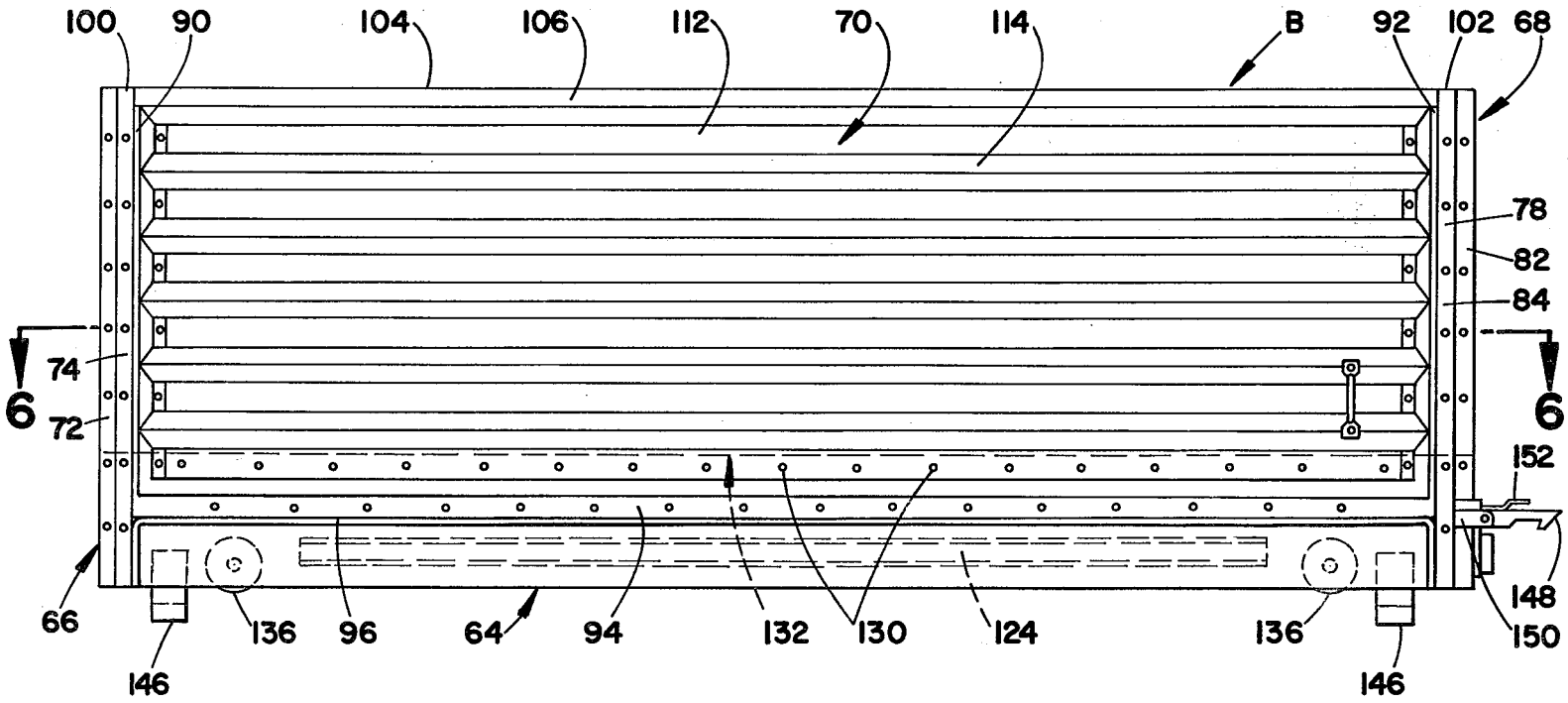
FIG. 4 is a front elevational view of a universal door repair section.

FIG. 4 shows a prefabricated door repair section B including a generally U-shaped repair section frame defined by repair section bottom frame member 64 and repair section opposite frame members 66, 68. A corrugated repair section panel 70 covers the repair section frame.

Figure 6:
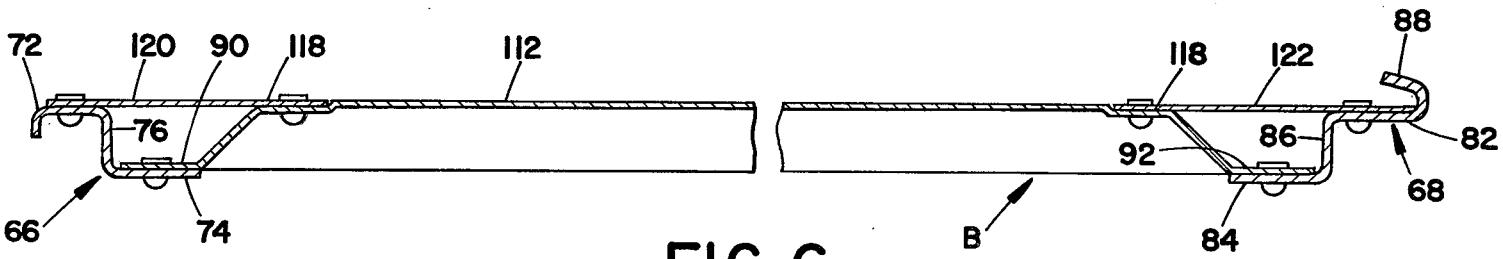
FIG. 6 is a cross-sectional view of the universal door repair section generally taken along lines 6—6 of FIG. 4.

As best shown in FIG. 6, repair section side frame member 66 is generally Z-shaped, and includes spaced inner and outer flanges 72, 74 connected by a web 76. Outer flange 74 defines a panel mounting flange having an inner surface. Repair section side frame member 68 is of generally reversed Z-shaped configuration, and includes inner and outer flanges 82, 84 connected by a web 86. Outer flange 84 defines a panel mounting flange having an inner surface. The terminal end portion of inner flange 82 is formed with an integral reversely bent hook portion 88 for cooperation with a lip on a car door frame when a door is in its closed position.

Figure 9:
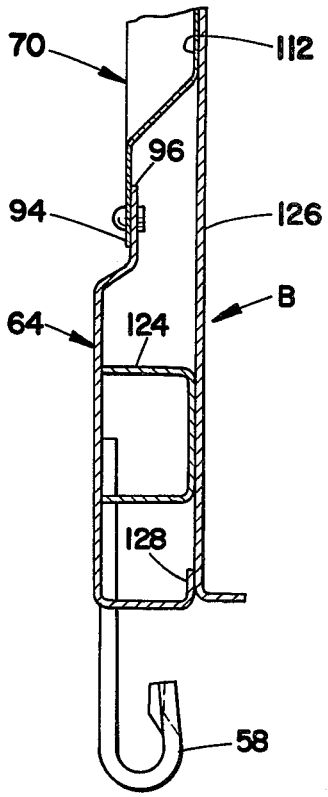
FIG. 9 is a partial cross-sectional elevational view generally taken along lines 9—9 of FIG. 8.
Figure 10:
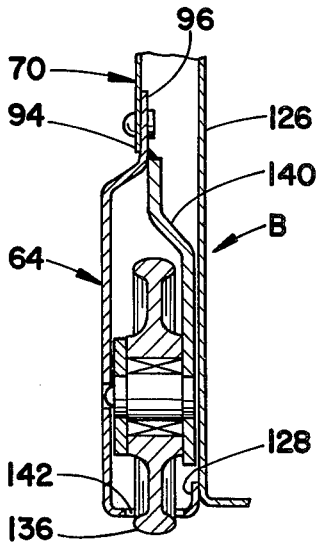
FIG. 10 is a partial cross-sectional elevational view generally taken along lines 10—10 of FIG. 8.

As shown in FIGS. 4 and 6, the entire periphery of repair section panel 70 is provided with flat portions all lying in a common plane. Opposite flat side panel portions 90, 92 are positioned against the inner surfaces of panel mounting flanges 74, 84 and are secured thereto by rivets. One-piece corrugated repair section panel 70 has a flat bottom peripheral portion 94 positioned against the outer surface of a panel mounting flange 96 on repair section bottom frame member 64. Flat bottom peripheral portion 94 is riveted to panel mounting flange 96 as shown in FIG. 9. The opposite end portions of repair section bottom frame member 64 are deformed inwardly to the same extent as panel mounting flange 96 and are welded or riveted against the inner surfaces of the panel mounting flanges 74, 84 on repair section side frame members 66, 68.

With reference to FIG. 4, top ends 100, 102 of repair section side frame members 66, 68 lie in a common plane with top edge 104 of repair section panel 70. Flat upper end portion 106 of repair section panel 70 lies in a common plane with the inner surfaces of panel mounting flanges 74, 84 on repair section side frame members 66, 68.

Panel 70 is corrugated so it undulates in a direction from the bottom of the panel to the top thereof. That is, the corrugations are elongated lengthwise between opposite repair section side frame members 66, 68. Panel 70 has flat concave corrugation portions 112 and convex corrugation portions 144.

With reference to FIG. 6, the rear surfaces of flat concave corrugation portions 112 lie substantially in a common plane with the rear surfaces of inner flanges 72, 82 on repair section side frame members 66, 68. The opposite ends of flat corrugation portions 112 are offset as indicated at 118 toward the front of the panel and continuous metal reinforcing strips 120, 122 are provided. One edge portion of continuous metal reinforcing strip 120 is riveted to inner flange 72 on repair section side frame members 66, and the other edge portion thereof is received in offsets 118 and riveted thereto. One edge portion of reinforcing strip 122 is positioned against the rear surface of inner flange 82 on repair section side frame member 68 and is riveted thereto. The other edge portion of reinforcing strip 122 is positioned in offsets 118 and similarly riveted thereto. Reinforcing strips 120, 122 close the openings defined by the shaped side frame members 66, 68 so material does not catch therein and also reinforce the edges of the repair section. The thickness of reinforcing strips 120, 122 is approximately the same as the offset distance for offsets 118. With this arrangement, the entire rear surface of the repair section lies substantially in a common flat plane.

A channel member 124 is welded to the rear surface of repair section bottom frame member 64 as shown in FIGS. 4 and 9. The rear surface of channel 124 lies substantially in a common plane with the rear surfaces of panel concave flat corrugation portions 112. A reinforcing strip 126 in FIG. 9 is welded to channel 124 and to an inner leg 128 of a generally U-shaped bottom portion on bottom frame member 64. The upper end portion of reinforcing strip 126 is riveted to the lowermost flat corrugation 112 as indicated by rivets 130 in FIG. 4. The upper edge of reinforcing strip 126 is indicated by numeral 132 in that figure.

Reinforcing channel 124 does not extend the full length of bottom frame member 64 and rollers 136 are suitably rotatably mounted outwardly thereof between bottom frame member 64 and a rear support bracket 140. This rear support bracket is welded at its upper end to bottom frame member 64 adjacent panel mounting flange 96 thereof. Suitable openings 142 in the bottom U-shaped portion of bottom frame member 64 have rollers 136 projecting therethrough for supporting door repair section B on a track. Hook-like members 146 are riveted to bottom frame member 64 outwardly of rollers 136 to serve as retainers by cooperating with a projecting flange on a door frame to prevent outward displacement of the door. A hook 148 is pivotally mounted as at 150 to a bracket secured to the bottom portion of repair section side frame member 68. A suitable leaf spring or the like 152 normally biases hook 148 downwardly in a clockwise direction to a horizontal position and allows upward pivotal movement thereof. Hook 148 cooperates with a projection on a car door frame for holding the door formed partly by repair section B in an open position.

Figure 5:
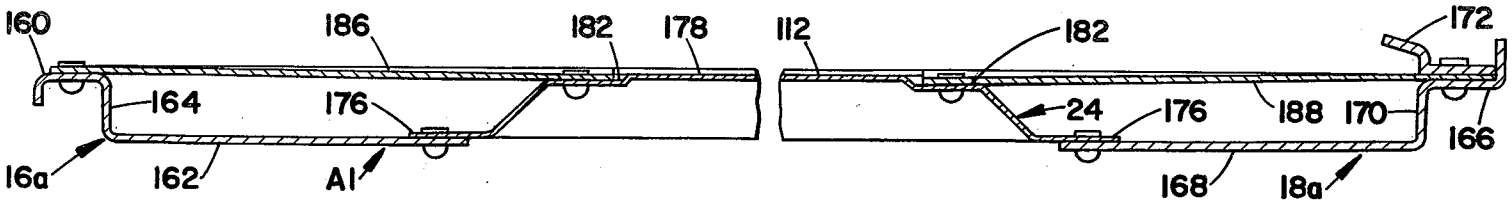
FIG. 5 is a cross-sectional view of an old door generally taken along lines 5—5 of FIG. 1.

As best shown in FIG. 5, the door from which undamaged upper section A1 is formed is constructed similarly to repair section B. Thus, undamaged upper section side frame member **16*a* is generally Z-shaped to include an inner flange 160 and an outer panel mounting flange 162 connected by a web 164. Undamaged upper section side frame member 18*a* is generally of a reversed Z-shaped configuration and includes an inner flange 166 connected to an outer panel mounting flange 168 by a web 170. A hook forming member 172 is riveted to inner flange 166 and thus provides a hook for receiving a seal member on a car door frame when a door is in a closed position. Corrugated panel 24 has opposite flat side portions 176 riveted against the inner surfaces of panel mounting flanges 162, 168. From FIG. 1, it will be seen that panel 24 has inner flat corrugation portions 178 and outer convex corrugation portions 180 and from FIG. 5, it will be seen that the rear surfaces of concave corrugations 178 lie substantially in a common plane with the rear surfaces of inner flanges 160, 166 on undamaged upper section side frame members 16*a*, 18*a*. The opposite end portions of flat concave corrugations 178 are offset at 182 back toward the front face of the panel. Reinforcing strips 186, 188 are suitably secured in position. Reinforcing strip 186 has one edge portion thereof riveted against the rear surface of inner flange 160 and its opposite edge portion riveted in offsets 182 of flat concave corrugation portions 178. Reinforcing strip 188 has one edge portion thereof riveted against the rear surface of flange 166 and its opposite edge portion received in offsets 182 and riveted thereto. The one edge portion of reinforcing strip 188 is located between inner flange 166 and hook member 172. Reinforcing strips 186, 188 have a thickness approximately the same as the offset distance for offsets 182**.

Although the scale of the various component parts, along with their locations and shapes is somewhat different in undamaged upper section A1 as compared to repair section B, the thickness of both sections from front to rear is approximately the same. Likewise, the width of the two sections is approximately the same so that the important or functional portions of repair section B will be aligned with undamaged upper section A1.

Figure 7:
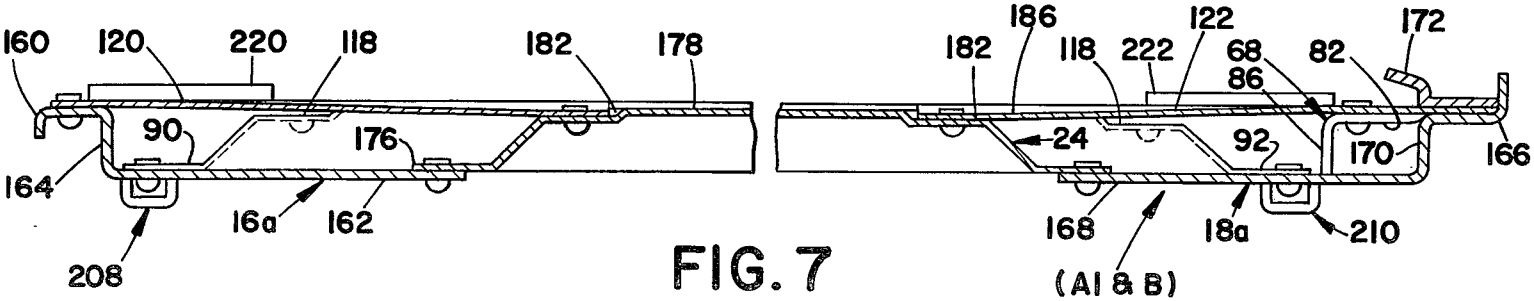
FIG. 7 is a cross-sectional elevational view showing the section of an old door of FIG. 5 superimposed on top of the section of the door repair section of FIG. 6.

FIG. 7 shows the sectional view of FIG. 5 superimposed on top of the section of FIG. 6. Thus, left side frame members 66, 16*a* substantially line up with one another. Inner flanges 72, 160 along with webs 76, 164 and portions of panel mounting flanges 74, 162 are also in alignment with one another as is particularly evident from FIG. 7. Likewise, hooks 88, 172 are in alignment, with hook 88 of the repair section being aligned below hook 172 of FIG. 7.

Repair section B is a universal replacement for many different types of doors so that the important component parts may be aligned with one another. Although undamaged upper section A1 is slightly wider than repair section B as shown in the FIGURES, this is unimportant because hooks 88, 172 line up with one another. The fact that flange 166 on upper section A1 extends outwardly beyond flange 82 on repair section B (FIG. 7) makes no difference in operation of a repaired door.

Figure 8:
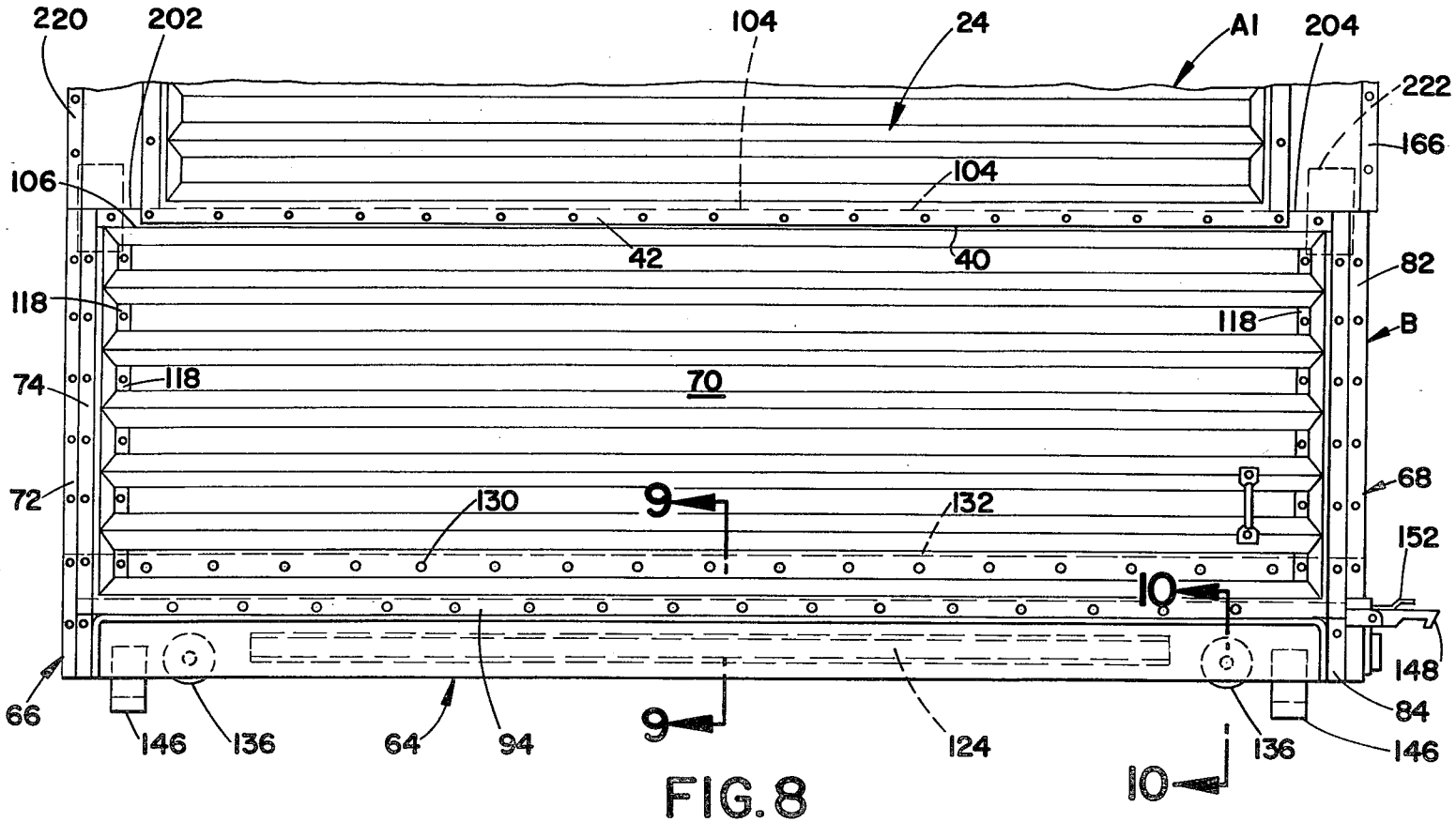
FIG. 8 is a front elevational view showing the universal door repair section of FIG. 4 connected to the undamaged upper section of FIG. 2A.

With reference to FIG. 8, repair section B is moved into position in place of damaged lower section A2 for securement to undamaged upper section A1. Top ends 100, 102 of repair section side frame members 66, 68 (FIG. 4) are moved into abutting engagement with bottom ends 36, 38 on side frame members 16*a*, 18*a* of undamaged upper section A1 (FIG. 2A) to define abutment joints 202, 204 in FIG. 8. These abutment joints are welded together. Flat projecting tongue 42 on corrugated panel 24 of undamaged upper section A1 overlaps flat upper portion 106 on repair section panel 70 to define lapped panel portions which are welded together. In addition, edge 40 of tongue 42 is welded along its length to flat upper portion 106 of repair section panel 70. Upper edge 104 of repair section panel 70 may also be welded to the rear surface of flat tongue portion 42.

Figure 11:
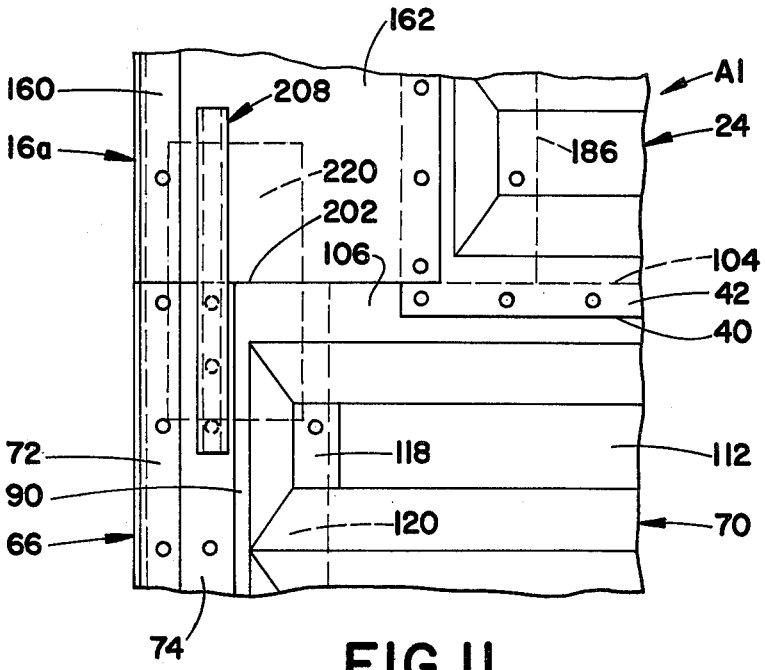
FIG. 11 is an enlarged front elevational view showing the frame joint between the undamaged upper section and the repair section; and, FIG. 12 is an enlarged view similar to FIG. 11 showing the opposite frame joint between the undamaged upper section and the repair section.
Figure 12:
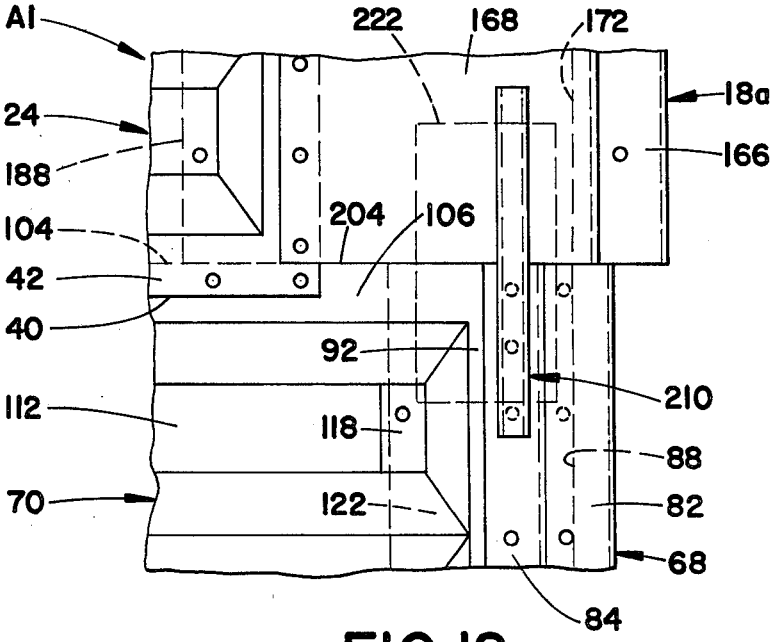

Spline members are also positioned across abutment joints 202, 204. To that end, and as best shown in FIGS. 7 and 11, a spline member 208 in the form of a channel has the end edges of its legs positioned against the outer surfaces of panel mounting flanges 74, 162 on side frame members 66, 16*a*. The longitudinal free edges of the channel legs are welded to these outer surfaces. At the opposite side of the door assembly, and as shown in FIGS. 7 and 12, a spline member 210, which defines a channel similar to member 208, has the end edges of its legs positioned against the outer surfaces of panel mounting flanges 84, 168 on side frame members 68, 18*a*. The free leg edges of channel 210 are similarly welded to these outer surfaces. Although channels 208, 210 are shown in the FIGURES in a generally vertical orientation relative to the top and bottom areas of the door, it should be appreciated that it is possible, and in some cases desirable, to locate them in a horizontal orientation along the joint.

As will best be seen in FIGS. 7, 11 and 12, rectangular metal plates 220, 222 are positioned across abutment joints 202, 204 against rear reinforcing strips 120, 186 and 122, 188. The periphery of metal plates 220, 222 are welded to the reinforcing strips with which they engage. It will be recognized that the abutment edges of the reinforcing strips are also located by numerals 202,204 in FIGS. 11 and 12. When a damaged section A2 is removed from a door A to leave an undamaged upper section A1, the bottom edges of reinforcing strips 186, 188 lie in approximately the same horizontal plane as bottom ends 36,38 on undamaged section side frame members 16*a*, 18*a*.

The repaired door is now formed by original undamaged upper section A1 along with a repair section B. The repaired door can be rehung and used in the same manner as the original door.

The invention has been described with reference to a preferred embodiment. Obviously, modifications and alterations will occur to others upon a reading and understanding of this specification. It is intended to include all such modifications insofar as they come within the scope of the appended claims or the equivalents thereof.

Having thus described the invention, it is now claimed:

1. A method of repairing a damaged lower section of a generally rectangular metal door of the type including a frame having opposite side door frame members and top and bottom door frame members covered by panel means affixed thereto, said damaged lower section extending substantially less than one-half the length of said side door frame members upwardly from said bottom frame member, said method comprising the steps of:

removing said entire damaged lower section including said bottom door frame member along with substantially equal damaged section lengths of said side frame members and that portion of said panel means affixed thereto;

removal of said damaged lower section leaving a substantially undamaged upper section having a frame of generally inverted U-shaped configuration including said top door frame member along with undamaged upper section lengths of said side door frame members, said undamaged upper section lengths of said side door frame members having bottom ends and said undamaged upper section being covered by an undamaged upper section panel portion of said panel means, said undamaged upper section panel portion having a bottom edge extending across said undamaged upper section lengths of said side door frame members adjacent said bottom ends thereof;

providing a prefabricated door repair section for replacing said damaged lower section, said door repair section having a generally U-shaped repair section frame including repair section side frame members of substantially the same length as said damaged section lengths of said door side frame members and a repair section bottom frame member, said repair section side frame members having top ends and said repair section frame being covered by a repair section panel having an upper edge extending across said repair section side frame members adjacent said top ends thereof;

positioning said repair section in place of said damaged lower section; and, securing said repair section side frame members to said upper section lengths of said door side frame members and securing said repair section panel to said undamaged upper section panel portion.

2. The method as defined in claim 1 wherein said step of positioning said repair section in place of said damaged lower section is carried out by abutting said top ends of said repair section side frame members with said bottom ends of said undamaged lengths of said side door frame members on said undamaged upper section to define frame abutment joints.

3. The method as defined in claim 2 wherein said step of securing said repair section side frame members to said upper section lengths of said door side frame members includes the step of positioning spline members across said frame abutment joints, and welding said spline members to said repair section side frame members and to said undamaged upper section lengths of said door side frame members.

4. The method as defined in claim 3 wherein said step of positioning spline members across said frame abutment joints is carried out by positioning channel-shaped spline members across said frame abutment joints.

5. The method as defined in claim 2 wherein said step of securing said repair section side frame members to said upper section lengths of said door side frame members includes the step of positioning spline members across said frame abutment joints on both inner and outer surfaces of said repair section and said undamaged upper section, and welding said spline members to said inner and outer surfaces.

6. The method as defined in claim 1 wherein said step of positioning said repair section in place of said damaged lower section is carried out by extending past one another said top edge of said repair section panel and said bottom edge of said undamaged upper section panel portion to define lapped panel portions, and said step of securing said repair section panel to undamaged upper section panel portion being carried out by welding said lapped panel portions together.

7. The method as defined in claim 1 wherein said step of removing said entire damaged lower section is carried out to leave said undamaged upper section with said bottom edge of said upper section panel portion spaced outwardly below said bottom ends of said upper section lengths of said door side frame members to define an upper section panel tongue portion, said step of positioning said repair section in place of said damaged lower section being carried out by abutting said bottom ends of said undamaged lengths of said side door frame members on said undamaged upper section to define frame abutment joints, said step of positioning said repair section in place of said damaged lower section further being carried out by lapping said upper section panel tongue portion past said top edge of said repair section panel to define lapped panel portions, said step of securing said repair section panel to said undamaged upper section panel portion being carried out by welding said lapped panel portions together, said step of securing said repair section frame members being carried out by welding together said frame abutment joints and by positioning spline members across said frame members and to said undamaged upper section lengths of said door side frame members.

8. A generally rectangular lower repair section for a metal rail car door comprising: a generally U-shaped frame including upright side frame members and a bottom frame member, said side frame members having upper ends and said frame being covered by a corrugated metal panel, said side frame members having panel mounting flanges including inner surfaces with said panel being secured to said flanges against said inner surfaces and wherein said panel has an upper edge extending across said side frame members adjacent said upper ends thereof, and said panel further having an upper flat portion adjacent said upper edge thereof with said upper flat portion having an outer surface lying substantially in a common plane with said flange inner surfaces.

9. The door repair section as defined in claim 8 wherein said side frame members include left and right side frame members, said left side frame member having a generally Z-shaped cross-sectional configuration including a rear flange and a front panel mounting flange connected by a web, said right side frame member having a generally reversed Z-shaped cross-sectional configuration including a rear flange and a front panel mounting flange connected by a web, said panel having flat panel side portions secured to said panel mounting flanges in engagement with said inner surfaces thereof, said panel being corrugated to undulate from top to bottom of said repair section and having concave portions spaced laterally from said rear flanges and extending generally coextensive therewith, and reinforcing strips secured between said rear flanges and said concave portions of said corrugations.

10. The door repair section as defined in claim 9 wherein said generally reversed Z-shaped side frame member includes an integral reversely bent sealing hook extending therefrom in outwardly-spaced opposed relationship thereto.

11. The door repair section as defined in claim 9 wherein said side frame members are connected adjacent said top ends thereof only by said panel and said top edge of said panel is coextensive with said top ends of said frame members, and said bottom frame member having rollers mounted thereto and extending downwardly therefrom.

* * * * *